US007591506B2

(12) United States Patent
Flannery

(10) Patent No.: US 7,591,506 B2
(45) Date of Patent: Sep. 22, 2009

(54) CHILD BOOSTER SEAT TUCKABLE UNDER THE TABLE

(75) Inventor: Mark A Flannery, Lakeville, MN (US)

(73) Assignee: Regale International, LLC, Prior Lake, MN (US)

( * ) Notice: Subject to any disclaimer, the term of this patent is extended or adjusted under 35 U.S.C. 154(b) by 0 days.

(21) Appl. No.: 11/809,193

(22) Filed: May 30, 2007

(65) Prior Publication Data

US 2008/0296938 A1 Dec. 4, 2008

(51) Int. Cl.
*A47D 1/10* (2006.01)

(52) U.S. Cl. ..... 297/174 CS; 297/174 R; 297/228.12; 297/140; 297/141; 297/142; 297/143; 108/143; 108/147.21

(58) Field of Classification Search ..... 297/174 CS, 297/174 R, 228.12, 140, 141, 142, 143; 108/143, 108/147.21

See application file for complete search history.

(56) References Cited

U.S. PATENT DOCUMENTS

| | | | | | |
|---|---|---|---|---|---|
| 887,529 | A * | 5/1908 | Schnee | 5/96 |
| 1,501,443 | A * | 7/1924 | Ellis | 297/143 |
| 1,525,011 | A * | 2/1925 | Stoltz | 297/142 |
| 1,606,541 | A * | 11/1926 | Straith | 297/141 |
| 2,493,187 | A * | 1/1950 | Ducey | 297/174 CS |
| 2,821,241 | A * | 1/1958 | Schwahn | 297/141 |
| 2,845,995 | A * | 8/1958 | Landry | 297/423.28 |
| 2,956,617 | A * | 10/1960 | Bruderer et al. | 297/141 |
| 3,021,185 | A * | 2/1962 | Kowalczyk | 312/29 |
| 3,133,760 | A * | 5/1964 | Robinson | 297/174 CS |
| 3,160,437 | A * | 12/1964 | Hill | 297/174 CS |
| 3,977,722 | A * | 8/1976 | Gist | 297/143 |
| 4,014,592 | A * | 3/1977 | Gist | 297/143 |
| 5,329,865 | A * | 7/1994 | McWard | 109/50 |
| 5,531,159 | A * | 7/1996 | Stubblefield | 108/102 |
| 5,921,621 | A * | 7/1999 | Cook et al. | 297/16.2 |
| 6,053,117 | A * | 4/2000 | Daoud | 108/143 |
| 6,435,186 | B1 * | 8/2002 | Klemm | 128/845 |
| D481,209 | S * | 10/2003 | Chen | D6/333 |
| 6,679,549 | B2 * | 1/2004 | Catelli | 297/174 CS |
| 6,736,451 | B1 * | 5/2004 | Chen | 297/174 CS |
| 7,021,719 | B2 * | 4/2006 | Stoll | 297/485 |
| 7,032,970 | B1 * | 4/2006 | Kharat | 297/256.11 |
| 7,156,465 | B2 * | 1/2007 | Stewart et al. | 297/411.36 |
| 2008/0203780 | A1 * | 8/2008 | Anselmi et al. | 297/174 CS |

* cited by examiner

*Primary Examiner*—Katherine W Mitchell
*Assistant Examiner*—Philip S Kwon

(57) ABSTRACT

A seat for a child that is engageable to an edge portion of a table and that is tuckable to an out-of-the-way position under the edge of the table. The seat includes jaws for engaging a base of the seat to the table. The seat includes a child seat frame on which the fabric of a child seat is engaged. Between the base and the child seat frame is provided a slide and a pivot. The slide permits the child seat frame to be drawn to and away from the table. The pivot permits the child seat frame to drop down in a swinging fashion and then, beyond the ninety degree bottommost point of the swing, continue its swinging so as to swing upwardly to a position underneath the table where the child seat frame is engaged in an out-of-the-way position underneath the table.

6 Claims, 3 Drawing Sheets

16
38
36
60
70
64
72
74
18

18
64
74
72
54
24
16
70
22
42

18
12
64
74
72
70
16
50
20

CHILD BOOSTER SEAT TUCKABLE UNDER THE TABLE

FIELD OF THE INVENTION

The present invention relates generally to a child booster seat, particularly to a child booster seat that is engageable to a table, and specifically to such a child booster seat that can be tucked to an out-of-the-way position underneath the table.

BACKGROUND OF THE INVENTION

A child booster seat can take several forms. For example, a child booster seat can be in the nature of a box that is placed on an adult chair. Or a child booster seat can be in the nature of a seat that is engaged to an edge portion of a table.

When the child booster seat is of the type that is engaged to an edge portion of a table, it may be relatively difficult to fix the seat to the edge portion of the table. The connections for such a fixing may be such that a caregiver must drop down to his or her knees and then twist his or her back to get his or head into a location where he or she can look at the connection that he or she is manipulating under the table. Such a task is also undertaken when the child booster seat is removed from the table. The double tasks of fixing and removing the child booster seat may be done at breakfast, lunch and again at dinner.

If the caregiver decides to keep the child booster seat engaged to the table throughout the day or for extended periods of time, then mobility about the table is reduced. Kitchens and dining rooms and their tables and chairs are likely never designed or selected with the possibility of the kitchen or dining room table having an odd protruding portion. Such exactly comes into play when babies are born.

SUMMARY OF THE INVENTION

A feature of the present invention is child booster seat that includes an upright and operating position at an edge of a table and an out-of-the-way position underneath the table.

Another feature of the present invention is the provision in such a child booster seat having a base frame portion and a seat support frame portion, of a slide between the base frame portion and seat support frame portion.

Another feature of the present invention is the provision in such a child booster seat having a base frame portion and a seat support frame portion, of a pivot between the base frame portion and seat support frame portion.

Another feature of the present invention is the provision in such a child booster seat having a base frame portion and a seat support frame portion, of a linear portion of the seat support frame portion being in line with a frame section of the base frame portion when the child booster seat is in an upright and operating position, and of the linear portion of the seat support frame portion being fixed in at an acute angle relative to such frame section of the base frame portion when the child booster seat is in an out-of-the-way position underneath the table.

Another feature of the present invention is the provision in such a child booster seat having a base frame portion and a seat support frame portion, of a method for swinging the seat support frame portion relative to the base frame portion, wherein the seat support frame portion can be swung downwardly to a bottommost point and then, in the same motion, be swung upwardly to an out-of-the-way position underneath the table.

An advantage of the present invention is child safety. The base frame portion of the frame is fixed just once to a table. Thus, chances are maximized that a caregiver will take his or her time to fix the base frame portion to the table and that thus the base frame portion will be fixed well to the table. Such is in contrast to fixing and removing a child booster seat to a table three times a day, whereupon chances are maximized that a caregiver will quickly tire of such a task.

Another advantage of the present invention is convenience. The present child booster seat is available to be swung up to an upright and operating position not just for breakfast, lunch and dinner, but for snacks and playtime as well.

Another advantage of the present invention is mobility. The present child booster seat in its out-of-the-way position is swung beyond a vertical plane that almost tangentially intersects the table, where only frame portions of the present child booster seat protrude from the edge of the table. This provides a clear path for a caregiver who makes multiple trips about the kitchen or dining rooms even between breakfast, lunch and dinner.

DESCRIPTION

Figure 1:
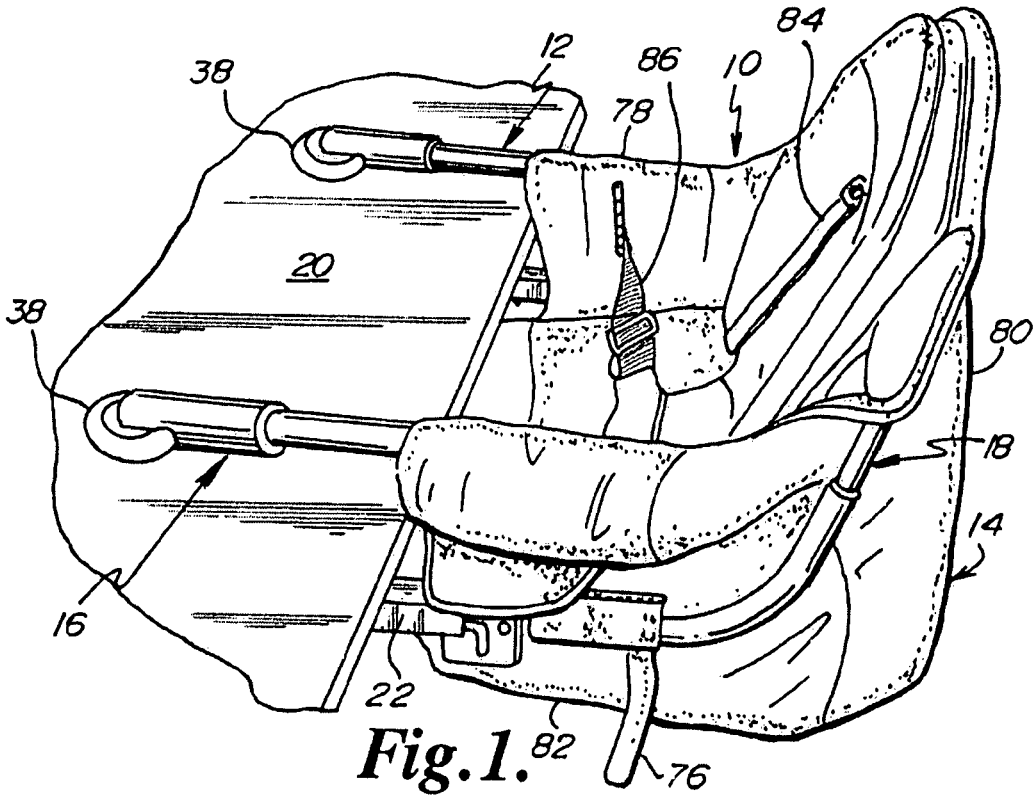
FIG. 1 is a perspective view of the present child booster seat apparatus where the child seat and its underlying seat support frame portion are in an upright and operating position and where a child in the booster seat apparatus is seated at an edge of a table.

As shown in FIG. 1, the present child booster seat apparatus is indicated in general by the reference numeral 10. Child booster seat apparatus 10 generally includes a frame 12 and a child seat 14. Frame 12 includes a base frame portion 16 and a seat support frame portion 18. Base frame portion 16 engages a table 20 (or table edge or table top) and seat support frame portion 18 engages the child seat 14.

Figure 2:
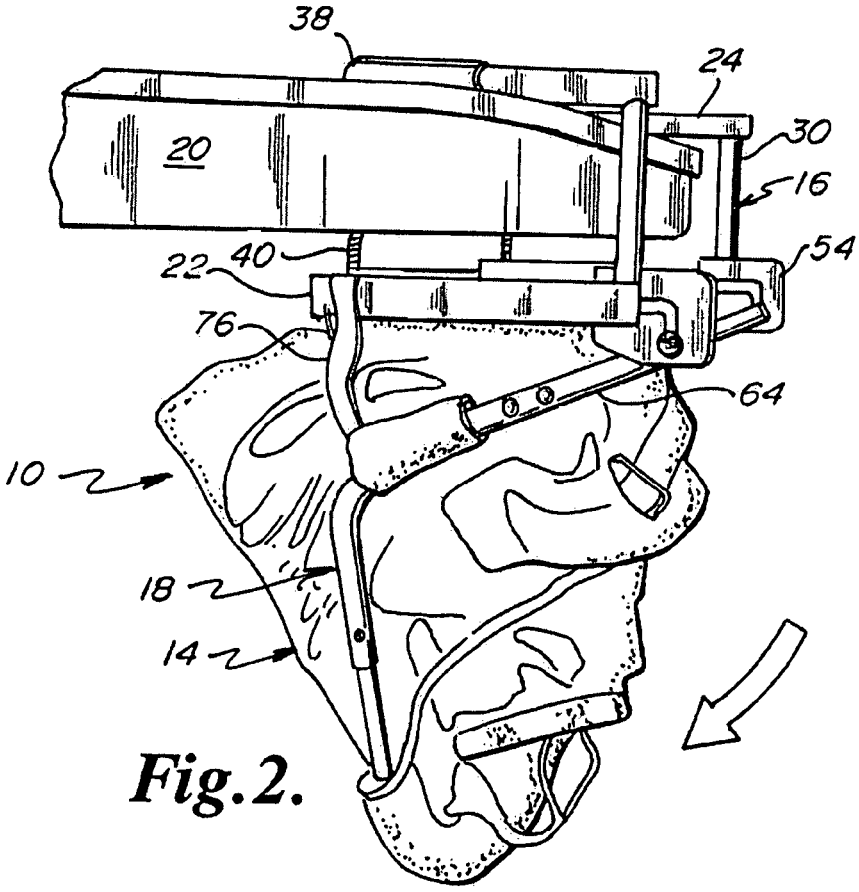
FIG. 2 is a perspective view of the child booster seat apparatus of FIG. 1 where the child seat and its underlying seat support frame portion are tucked in an out-of-the-way position underneath the table.

As shown in FIG. 2, the seat support frame portion 18 is swingable relative to the base frame portion 16 to an out-of-the-way position generally underneath table 20 and generally within or beyond a vertical plane defined generally by an edge of the table, generally by an outermost portion of frame portion 16, and specifically by slot 58.

Figure 3:
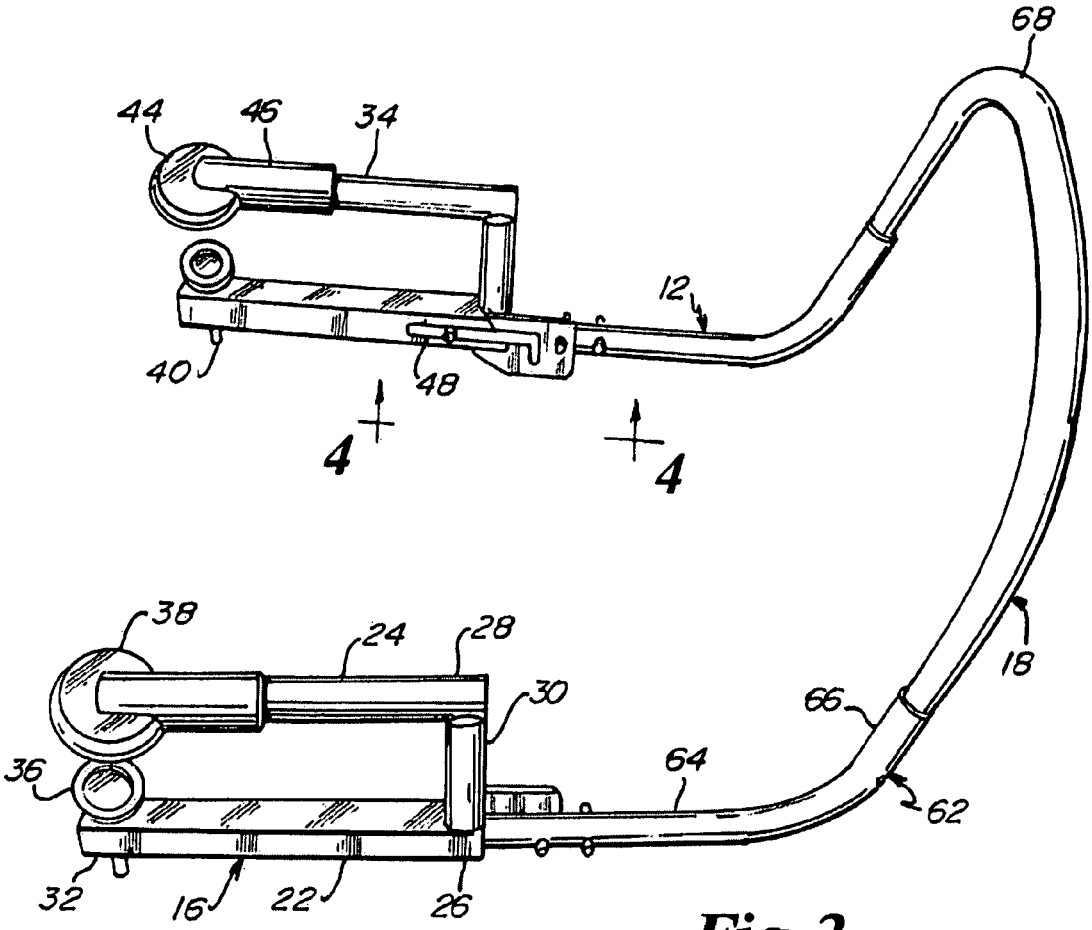
FIG. 3 is a perspective view of the frame of the child booster seat apparatus of FIG. 1 when the child seat and its underlying seat support frame portion are in the upright and operating position of FIG. 1.

As shown in FIG. 3, base frame portion 16 includes a square tube or frame section 22 opposing and running generally parallel to a circular tube 24. Table 20 or an edge portion of the table or the table top is received between the square tube 22 and the circular tube 24. Square tube 22 is generally square in lateral cross section. Square tube 22 includes a first end portion 26 and circular tube 24 includes a first end portion 28 and the end portions 26 and 28 are interconnected or engaged to each other, such as by welding, via an intermediate post 30 that may confront or abut an edge of table 20. Square tube 22 includes a second end portion 32 and circular tube 24 includes a second end portion 34. Threadably connected to the second end portion 32 is a first jaw 36. Slideably and frictionally fit on the second end portion 34 is a second jaw 38. First jaw 36 is generally shaped in the form of a disk having an upwardly extending annular rim with a flat face and is affixed to second end portion 32 via a pin connector 40 that is threadingly engaged with second end portion 32 of first jaw 36. First jaw 36 is fixed to the upper end of pin connector 40 such that turning of the first jaw 36 (and or fin 42) also turns or rotates the pin connector 40 to raise or lower first jaw 36 relative to square tube 22. First jaw 36 is turned up and down to move jaws 36 and 38 relatively to and away from each other and to fix the table 20 therebetween via a handle or finger piece 42 engaged to the underside of the disk shaped jaw 36. Handle or finger piece 42 may be formed in the shape of a fin extending diametrically relative to the first jaw 36 to aid in turning the first jaw 36 up and down relative to the square tube 22 and relative to the second jaw 38. Fin 42 and first jaw 36 may be integral and one-piece.

Second jaw 38 includes a disk shaped portion 44 and a tube section 46. Disk shaped portion 44 opposes first jaw 36. Tube section 46 slideably and frictionally engages second end 34 of tube 24. The under face of disk shaped portion 44 may be roughened to somewhat frictionally engage a table top. The upper face of the annular rim of jaw 36 may be roughened to somewhat frictionally engage an underside of a table top, or the upper face of the annular rim of jaw 36 may be relatively smooth to maximize the force with which jaw 36 may be hand turned to maximize the tightness of the bite between jaws 36 and 38.

Each of the jaws 36 and 38 may be formed of a resilient plastic or elastomer to provide a give thereto. If desired, jaw 36 may be formed of a plastic piece with no give such that jaw 36 is formed of a relatively hard plastic piece, which jaw 36 can oppose jaw 38 formed of a resilient plastic. Instead of a rim, the lower face of disk portion 44 of upper jaw 38 can extend generally continuously diametrically and, at the same time, be generally roughened.

The second end portion 32 of square tube 22 may be closed or open. The first end portion 26 of square tube 22 is open so as to receive linear portion 64 of seat support frame portion 18. The first end portion 26 further includes an open ended slot 48 running longitudinally of the square tube 22. Slot 48 includes a closed end or stop 50 and an open end 52 situated exactly at the absolute end of second end portion 32 of square tube 22. Slot 48 is formed in the inner longitudinal plate portion of the square tube 22, where square tube 22 has upper, lower, outer and inner longitudinal plate portions, each of which makes up one side of the square tube 22. Closed end 50 is referred to as a stop because abutment of closed end 50 by button 70 acts to stop an inwardly sliding of the linear portions 64 relative to the square tubes 22, which may occur when button 74 is depressed and the seat support frame portion 18 is pushed into base frame portion 16.

Figure 4:
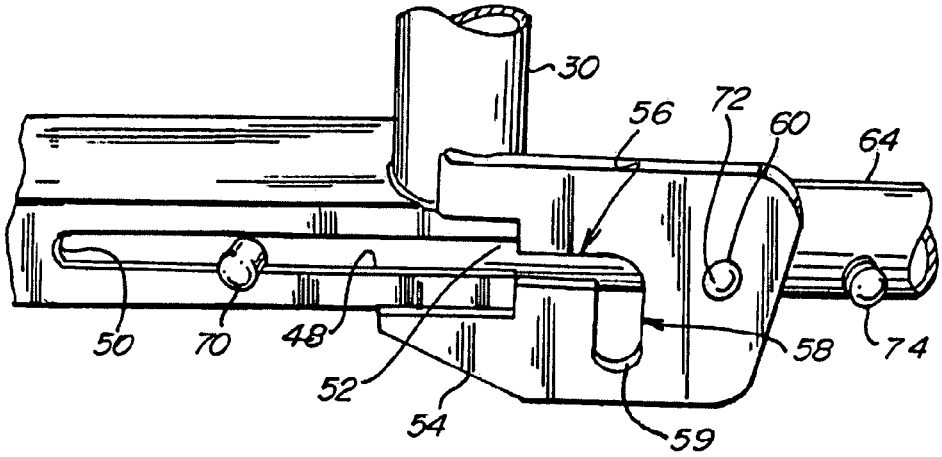
FIG. 4 is a perspective detail view of a slide and pivot mechanism of the child booster seat apparatus of FIG. 1.

As shown in FIG. 4, base frame portion 16 includes a metal plate 54 fixed, such as by welding, to the post 30 and square tube 22. Metal plate 54 is positioned at the face of the longitudinal inner plate portion of square tube 22. Metal plate 54 includes a horizontal slot portion 56 and a vertical slot portion 58 that communicate with each other. Horizontal slot portion 56 also communicates with slot 48 and is aligned with slot 48 in the horizontal direction or longitudinal direction of square tube 22. Vertical slot portion 58 is oriented at a right angle to slot 48 and to slot 56. Vertical slot portion 58 includes a pivot location 59 at the bottommost end of slot portion 58. Metal plate 54 further includes a hole or through opening 60 that is horizontally aligned with slot portion 56 and slot 48.

If desired, it should be noted that the structural components of base frame portion 16 can be integral and formed of one-piece. That is, square tube 22, post 30, circular tube 24 and metal plate 54 can be integral and formed of one-piece via a molding process, a welding process, or other process.

Seat support frame portion 18 is generally U-shaped, is round or circular in cross section, and is a tube. Seat support frame portion 18 includes a pair of L-shaped end sections 62. Each of the L-shaped end sections 62 includes a linear portion 64. Linear portion 64 slides into and out of the square tube 22. Each of the L-shaped end sections 62 further includes a rounded portion 66 extending upwardly and away from base frame portion 16. Engaged in open ends of rounded portions 66 is a U-shaped piece or medial or intermediate section 68 that interconnects the two L-shaped end sections 62.

Linear portion or linear tube portion 64 includes a set of three buttons or pins 70, 72 and 74. It is preferred that all three buttons 70, 72 and 74 are resiliently depressible into linear tube portion 64 such that linear tube portion 64 is disengageable from base frame portion 16. Button 70 is disposed near the absolute end of linear tube portion 64 such that linear tube portion 64 is completely slideable out of square tube 22. Button 70 rides or slides in slot 48 of square tube 22, and also rides or slides in slots or slot portions 56 and 58, such that button 70 can slide from slot 48 to slot 56 to slot 58 to pivot location 59. Upon reaching pivot location 59, button 70 along with its respective button 70 on the other linear tube portion 64, provide for a pivoting or swinging of the seat support frame portion 18 and child seat 14 relative to base frame portion 16. Button 70 and its paired button 70 are of sufficient strength to hold seat support frame portion 18 and the child seat 14 in the depending out-of-the-way position along with hanger 76.

Each of buttons 72 and 74 is engageable in hole 60. When so engaged, button 72 or 74 prevents an inadvertent sliding out and dropping of the seat support frame portion 18 and its child seat 14 relative to the base frame portion 16. Whereas button 70 operates as a pivot point for the seat support frame portion 18, buttons 72 and 74 operate in the nature of locks to prevent such an inadvertent sliding out and dropping, and its should be noted that each of the buttons 72 (or 74) on each of the linear tube portions 64 must be disengaged before the seat support frame portion 18 can be slid out to the pivoting location 59. It should be noted that two spaced apart buttons 72 and 74 are provided such that the distance of the child seat 14 relative to the edge of the table 20 may be adjusted. More buttons, spaced apart in the linear or longitudinal direction, may be provided if desired to provide a greater degree of adjustment.

The combination of one or more of the square tube 22, the linear portion 64 that slides therein, slots 48, 56 and 58, and buttons 70, 72 and 74 can be referred to as a slide or slide mechanism. The structural interaction between square tube 22 and linear portion 64 provides the strength needed to support a child in the child seat 14 and such portions, it should be noted, alone make up the definition of a slide or slide mechanism. The combination of one or more of the pivot location 59 and button or pin 70 can be referred to as a pivot or pivot mechanism. The structural interaction between such provides the strength needed to, along with hanger 76, hang the child seat 14 and its underlying seat support frame portion 18 underneath the table 20.

Child booster seat apparatus 10 further includes a hanger 76. Hanger 76 extends between and is engaged to and between seat support frame portion 18 and base frame portion 16 when the child seat 14 and the seat support frame portion 18 is in the out-of-the-way position shown in FIG. 2. Hanger 76 is shown in the form of a strap affixed to L-shaped portion 62 when the seat support frame portion 18 is in the upright and operating position shown in FIG. 1. However, the strap may be affixed to the base frame portion 16 when the seat support frame portion 18 is in the upright and operating position shown in FIG. 1. Hanger 76, instead of being in strap form, may take the form of a plastic hook that depends from, for example, base frame portion 16 when the child seat 14 is in the upright and operating position and that hooks onto the seat support frame portion 18 when the seat support frame portion 18 is in the out-of-the-way position. Regardless of the form that hanger 76 takes, it should be noted that linear tube portion 64 is aligned with square tube 22 and slot 48 when the child seat 14 is in the upright and operating position. When the child seat 14 is in the tucked position or out-of-the-way position shown in FIG. 2, the linear tube portion 64 is disposed at an acute angle relative to square tube 22 and its slot 48 and is disposed generally within or beyond a vertical plane defined by vertical slot 58 such that generally the child seat 14 is tucked within or beyond a vertical plane that intersects the edge of table 20. Hanger 76 can loop around the second end portion of square tube 22 and extend back to L-shaped section 62. One or two hangers 76 can be provided for a single child booster seat apparatus 10.

Child seat 14 is preferably formed of fabric. Child seat 14 preferably engages only seat support frame portion 18 such that the seat support frame portion 18 can readily slide out and pivot relative to the base frame portion 16. However, the child seat 14 can include arm rest portions 78 that lead into circular tubes 24 and that have the appearance of mating with, or actually mate with, circular tubes 24. Child seat 14 further includes a back portion 80, seat portion 82, shoulder straps 84 and a lap belt 86. Child seat 14 may include framing or tubing in addition to seat support frame portion 18, and such additional framing or tubing may be disposed within the arm rest portions 78 or within other portions of the child seat 14.

Figures 5, 6, 7:
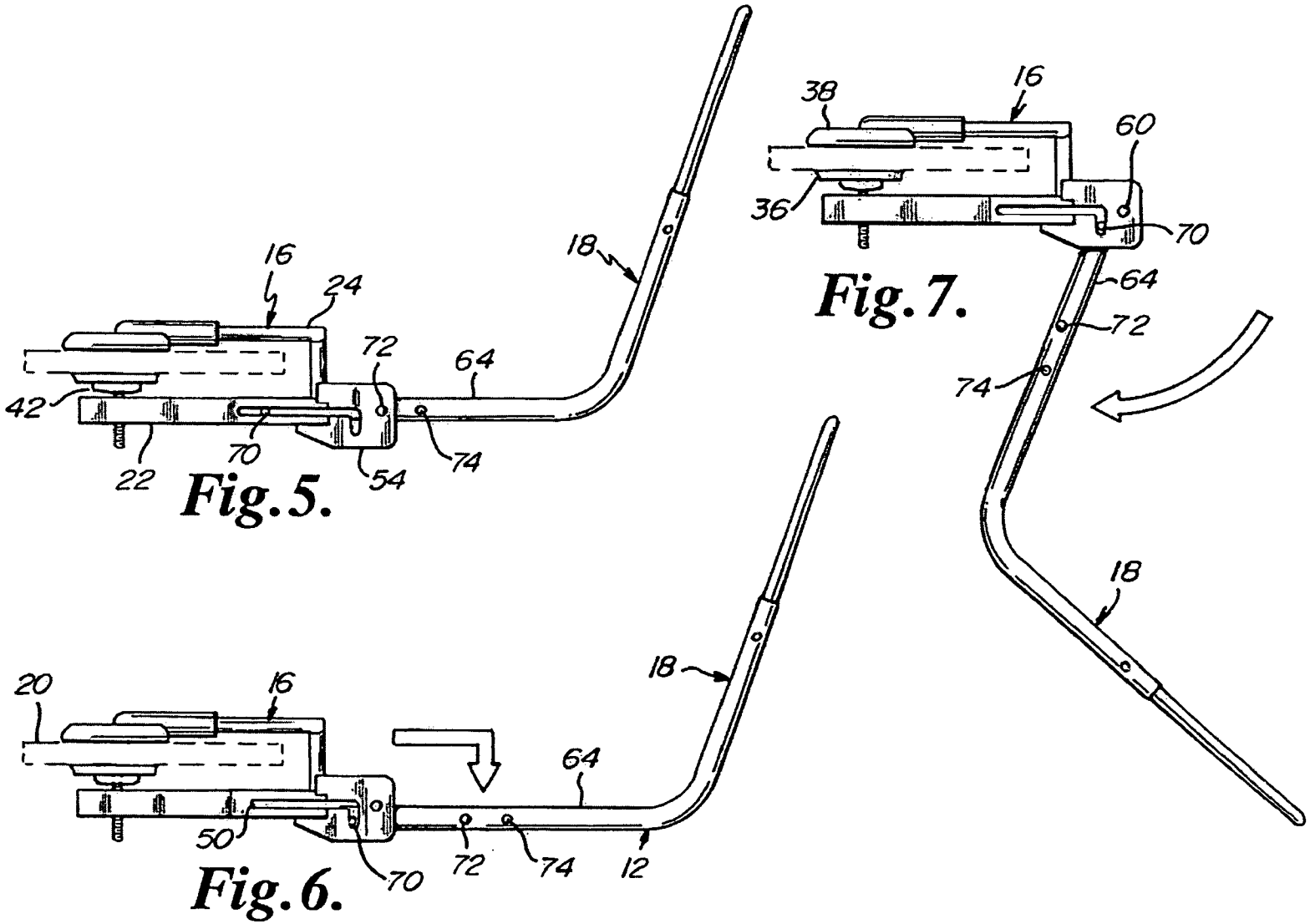
FIG. 5 is a side view of a portion of the frame of FIG. 3 showing the seat support frame portion in the upright and operating position and having been fully slid into position in the base frame portion.
FIG. 6 is a side view of a portion of the frame of FIG. 3 showing the seat support frame portion having been slid out and down to a pivot position relative to the base frame portion.
FIG. 7 is a side view of a portion of the frame of FIG. 3 showing the seat support frame portion in the pivot position and in the process of swinging to the out-of-the-way position.

In operation, the seat support frame portion 18 and base frame portion 16 may be stored in a disconnected fashion. To set up the child booster seta apparatus 10, base frame portion 16 can be engaged to the top of table 20 by inserting the base frame portion 16 relatively deeply into the table top until the edge of the table 20 confronts or abuts posts 30. Then the fins 42 of jaws 36 are turned to turn jaws 36 to raise jaws 36 upwardly and against the lower face of the table top such that each of the pairs of jaws 36 and 38 work against each other and bite the table top therebetween. When the base frame portion 16 is so engaged, the annular rims of jaws 36 bite against the underside of the table top, the disk shaped portions 44 bite against the upperside of the table top, and the lower faces of tube portions 46 may also bite against the upper side of the table top depending upon the resiliency of the disk shaped portions 44. Further, if abutting the edge of the table, posts 30 also act to minimize movement of the base frame portion 16. Thus, base frame portion 60 provides a safe and sturdy base for seat support frame portion 18 and its child seat 14. Then the child seat 14 can be engaged onto the seat support frame portion 18. Then the seat support frame portion 18 having the child seat 14 is connected to the base frame portion 16. This is accomplished by pushing in buttons 70 at the same time such that buttons 70 slide against the outer faces of metal plates 54 and by inserting the ends of linear portions 64 into the open ends 26 of the square tubes 22. Buttons 70 may be maneuvered around holes 60 such that buttons 70 pop out and into slot 56. Then the linear portions 64 of seat support frame portion 18 having the child seat 14 are further slid into the square tubes 22 of base frame portion 16 until buttons 72 abut the front edges of metal plates 54, whereupon buttons 72 can be depressed, whereupon the linear portions 64 of seat support frame portion 18 having the child seat 14 are further slid into the square tubes 22 of base frame portion 16 until buttons 72 pop into holes 60. At this point, the child booster seat apparatus 10 is ready for use such that a child may be lifted and set into the child seat 14. Then, if desired, the child may be drawn closer to the edge of the table 20 by pressing in buttons 72 with finger tips, sliding the linear portions 64 of seat support frame portion 18 forwardly and further into square tubes 22, and then depressing buttons 74 such that buttons 74 slide against the outer faces of metal plates 54 until buttons 74 pop out and into holes 60, whereupon the seat support frame portion 18 is again fixed securely relative to base frame portion 16. Then, after dinner, buttons 74 are depressed with the finger tips, seat support frame portion 18 is drawn out until buttons 72 are engaged in holes 60, the child is lifted out of the child seat 14, the buttons 72 are depressed with the finger tips and the seat support frame portion 18 is drawn outwardly such that buttons 70 slide from slots 48 into slots 56 and further into slots 58, whereupon the seat support frame portion 18 drops slightly until buttons 70 engage pivot locations 59, whereupon the seat support frame portion 18 is swung such that linear portion 64 swings from an aligned position with square tube 22 and its slot 48 to an acute position with square tube 22 and its slot 48 as shown in FIGS. 2 and 7, whereupon the hanger or strap 76 is looped about the second end 32 of square tube 22 to fix the seat support frame portion 18 in the tucked and out-of-the-way position. Then, for example at breakfast the next day, the process is reversed such that the strap 76 is disengaged, the seat support frame portion 18 is swung out from underneath the table 20, the seat support frame portion 18 is slightly lifted to slide the buttons 70 into slots 56, the seat support frame portion 18 is pushed to slide buttons 70 from slots 56 to slots 48, buttons 72 are manipulated to fix the child seat 14 securely relative to base frame portion 16, the child is set into the child seat 14 and then, if desired, the child and seat support frame portion 18 are pushed closer to the edge of the table 20, whereupon buttons 74 are engaged or locked in holes 60.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A booster seat apparatus for being engaged to a table having an edge, comprising:

a) a tubular seat support frame portion comprising a pair of end sections and a medial section that interconnects the end sections, with each of the end sections comprising a linear tubular portion, with each of the linear tubular portions comprising a pin, with the medial section comprising a tubular U-shaped piece;

b) a child seat engaging said tubular seat support frame portion;

c) a base frame portion comprising:

i) a pair of first tubes for slideably receiving the linear tubular portions of the tubular seat support frame portion, with each of the linear tubular portions being slideable completely out of said first tubes, with each of the first tubes having first and second end portions, with each of the first end portions being open to receive one of the linear tubular portions, with each of the second end portions having a first jaw;

ii) a pair of second tubes, with each of the second tubes opposing and running generally parallel to one of the first tubes, with each of said second tubes being interconnected to said first tube to which said second tube opposes and runs parallel, with each of the second end portions having a second jaw, with each of the second jaws opposing one of the first jaws, with the edge of the table being received between the first and second tubes;

iii) a pair of drop pivot locations into which the pins of the linear tubular portions are dropped and engaged after said linear tubular portions slide completely out of said first tube such that said linear tubular portions can swing relative to said first tubes, such that said linear tubular portions are disposed at an acute angle relative to said first tubes, when said child seat is swung to a position underneath the table; and iv) wherein each of the drop pivot locations comprises a drop pivot slot that is perpendicular to the longitudinal length of the tubes; and d) a strap engageable between the base frame portion and the seat support frame portion, wherein the strap is engaged when the seat support frame portion is underneath the table, wherein the strap has a length greater than a length of the drop pivot slots such that the seat support frame portion hangs at an acute angle relative to the base frame portion when the strap is engaged between the base frame portion and the seat support frame portion.

2. The booster seat apparatus of claim 1, wherein the first tube comprises a first slot, with said pin of said linear tubular portion sliding in said first slot when said linear tubular portion slides in said first tube, with said first slot communicating with said drop pivot location.

3. The booster seat apparatus of claim 1, wherein the first tube comprises a first slot, with said pin of said linear tube portion sliding in said first slot when said linear tubular portion slides in said first tube, wherein said first slot and respective said drop pivot slot are disposed at a right angle relative to each other.

4. The booster seat apparatus of claim 1, and further comprising a lock between the base frame portion and seat support frame portion to prevent said linear tube portion and said first tube portion from being slideable relative to each other.

5. The booster seat apparatus of claim 1, and further comprising a lock between the base frame portion and seat support frame portion, with the seat support frame portion including a first locked position and a second locked position, with the seat support frame portion being at the upright and operating position at each of the first and second locked positions, and with the seat support frame portion being at a different distance from the table at each of the first and second locked positions.

6. A method for storing a child booster seat underneath a table having an edge, wherein the child booster seat comprises a frame, wherein the frame comprises a base frame portion engaged to the table, wherein said base frame portion comprises a pair of first tubes having first jaws and a pair of second tubes having second jaws, wherein said base frame portion further comprises a pair of drop pivot locations, wherein each of the drop pivot locations comprises a drop pivot slot that is perpendicular to the longitudinal length of the first tubes, wherein the frame further comprises a seat support frame portion having a pair of linear tubular portions, wherein each of the linear tubular portions comprises a pivot pin, wherein said linear tubular portions are slideable into and out of the first tubes of the base frame portion, wherein the method comprises the steps of:

engaging the base frame portion to the table by the jaws, with the edge of the table being received between the first and second tubes;

sliding the linear tubular portions completely out of the first tubes of the base frame portion such that said pivot pins of said linear tubular portions are dropped into and engaged with said drop pivot locations of said base frame portion;

swinging the linear tubular portions relative to the base frame portion in a downward direction such that the linear tubular portions are swung to and beyond ninety degrees relative to the base frame portion such that the linear tubular portions begin to swing upwardly to an acute position relative to the base frame portion;

fixing one of the linear tubular portions in said acute position such that the seat support frame portion is fixed underneath the table; and providing a strap engageable between the base frame portion and the seat support frame portion, wherein the strap is engaged when the seat support frame portion is underneath the table, wherein the strap has a length greater than a length of the drop pivot slots such that the seat support frame portion hangs at said acute angle relative to the base frame portion when the strap is engaged between the base frame portion and the seat support frame portion.

* * * * *